US006648932B1

(12) United States Patent
Maton

(10) Patent No.: US 6,648,932 B1
(45) Date of Patent: Nov. 18, 2003

(54) GASIFICATION REACTOR APPARATUS

(75) Inventor: Maurice Edward George Maton, Ashurst (GB)

(73) Assignee: Graveson Energy Management Ltd. (GB)

( * ) Notice: Subject to any disclaimer, the term of this patent is extended or adjusted under 35 U.S.C. 154(b) by 0 days.

(21) Appl. No.: 09/485,562

(22) PCT Filed: Jun. 16, 1999

(86) PCT No.: PCT/GB99/01915

§ 371 (c)(1),
(2), (4) Date: Mar. 15, 2000

(87) PCT Pub. No.: WO99/66008

PCT Pub. Date: Dec. 23, 1999

(30) Foreign Application Priority Data

Jun. 16, 1998 (GB) ..... 9812984

(51) Int. Cl.[7] ..... C10J 3/00

(52) U.S. Cl. ..... 48/119; 48/123; 48/61; 48/62 R; 48/81; 48/85.2; 48/89; 48/111; 422/164; 422/184.1; 422/198; 422/204; 422/226; 422/227; 422/232; 422/233

(58) Field of Search ..... 422/164, 184.1, 422/198, 202, 204, 207, 224, 225, 226, 227, 229, 232, 233; 48/127.3, 127.5, 61, 62 R, 81, 85.2, 89, 111, 119, 123

(56) References Cited

U.S. PATENT DOCUMENTS

| | | | | |
|---|---|---|---|---|
| 1,798,995 A | | 3/1931 | Bartling | |
| 1,979,176 A | * | 10/1934 | Schicht | 406/79 |
| 3,402,684 A | * | 9/1968 | Gradischer et al. | 110/102 |
| 3,572,661 A | * | 3/1971 | Muller | 261/86 |
| 3,648,804 A | * | 3/1972 | Kamp et al. | 184/64 |
| 4,224,019 A | | 9/1980 | Dilmore | |
| 4,321,877 A | | 3/1982 | Schmidt et al. | |
| 6,250,913 B1 | | 6/2001 | Maton | |

FOREIGN PATENT DOCUMENTS

| | | | | |
|---|---|---|---|---|
| DE | 31 34 333 | | 5/1982 | |
| EP | 0 269 487 | | 6/1988 | |
| FR | 544.934 | | 10/1922 | |
| FR | 2 398 966 | | 2/1979 | |
| FR | 2 566 792 | | 1/1986 | |
| GB | 2 290 608 | | 1/1996 | |
| GB | 2303693 A | * | 2/1997 | F28C/3/06 |
| HU | 52146 | | 6/1990 | |
| HU | 53669 | | 11/1990 | |
| HU | 68478 | | 6/1995 | |
| HU | 69869 | | 9/1995 | |
| HU | 76154 | | 7/1997 | |
| HU | 76910 | | 12/1997 | |
| NL | 9 100 767 | | 12/1992 | |
| NL | 1 004 647 | | 6/1998 | |

* cited by examiner

*Primary Examiner*—Jerry D. Johnson
*Assistant Examiner*—Basia Ridley
(74) *Attorney, Agent, or Firm*—Nields & Lemack

(57) ABSTRACT

A gasification reactor apparatus (10) comprising a gasification vessel (12), a gas-fired combustion chamber (70) and a combination fan and cyclone unit (20) in an upper part (12') of the vessel (12) with two functions: first, the fan (62, 64) impels incoming feedstock (14, 14') centrifugally into contact with the hot inside surface of the vessel to produce rapid onset of gasification. Second, the unit (20) exerts a cyclonic motion on the product gas causing outward separation of particulate matter from the gas, which passes to the outlet via a path through the middle of the vessel (12).

25 Claims, 5 Drawing Sheets

GASIFICATION REACTOR APPARATUS

The present invention relates to a gasification reaction apparatus.

More particularly, the subject apparatus is for converting organic materials, or materials containing organic matter, into high calorific value gas. It is especially applicable to the disposal of wastes.

There is an ever-pressing need to dispose of wastes such as commercial and municipal (domestic) wastes. Land-fill has been a traditional means of disposal but has numerous drawbacks which are well known. Incineration is a possibly better method of disposal, but has its limitations. In particular, energy conversion rates are comparatively low, and the utilization of waste heat, such as for district heating, is beset with efficiency problems and high capital costs of heat distribution. Incinerators produce large volumes of flue gases of low calorific value. They must be cleaned, expensively, before discharge to the atmosphere. Incinerators also yield large quantities of ash, which require disposal.

Incineration therefore is by no means an ideal alternative to land-fill.

Gasification is a potentially attractive alternative to incineration. In gasification, organic matter is decomposed directly, i.e. converted pyrolytically in the absence of air, into combustible gas and ash. Unfortunately, with present gasifiers the gas produced is heavily contaminated with carbon and ash particles. The gas needs considerable and costly cleaning before it can be efficiently utilized as a source of heat or for conversion into electricity. Frequently, the gas produced by existing gasification plant is contaminated with highly toxic dioxins.

The present invention has for its object the development of a highly efficient converter or gasifier capable of yielding clean, high calorific value gas with minimal ash. Another object is to devise an adaptable converter or gasifier design suitable for implementation in large-scale municipal waste disposal sites, as well as for implementation in small sites such as in hotels, factories and shopping precincts. In the latter implementation, the gasifier desirably would provide all the energy needs of the site, and could make it substantially self-sufficient.

A municipal waste disposal plant embodying the present gasification reaction apparatus can be organised as described in the following overview.

Incoming solid waste is passed to a sorting station. Here, ferrous and non-ferrous metal objects are removed. Also removed are ceramic and vitreous objects. The remaining solid waste is primarily of organic matter, including cellulosic, plastics and rubber materials. The waste is now passed to a shredding station, to be broken down into small particles of relatively uniform size. At this stage, the waste will normally contain large amounts of moisture, so it is passed to a drier. Energy for the drier is taken from the exhaust of the boiler/engine and used for the further conversion of gas to usable energy, ie electricity or heat. Moisture driven off as water vapour may be condensed for discharge to a sewer.

The dried waste, if in the form of a cake is comminuted, and is then delivered to the gasifier for decomposition into flammable gas and ash. The gas which is produced can be used for various purposes, but the primary use is for driving a gas turbine generator for producing electricity, some or all of which may be supplied for gain to the national grid system. Some of the gas is used for heating the gasification apparatus. Exhaust from the later can be used to heat the drier indirectly. Exhaust from the gas turbine generator can be fed to a heat exchanger for producing superheated steam, for powering a steam turbine generator. Some of the steam might be used for heating the drier. Electricity produced by the steam turbine generator may be utilised for the plant installation's needs or may be supplied for gain to the grid system.

It will be seen from the foregoing outline that a gasification plant is economically highly desirable. Acquisition of the fuel, (waste), may cost the plant operator nothing. Indeed, the operator may well be able to charge waste producers for disposing of the waste. Once up and running, the plant need have no significant operational costs other than staffing and routine maintenance and repair. The energy input for operating the plant can be derived effectively from the waste itself. Surplus energy derived from the waste can be sold for profit, e.g. as electrical or thermal energy.

By this invention, a method of gasifying solid or liquid organic matter for producing high calorific value product gas, involves the steps of heating a gasification vessel to elevated temperature while excluding air therefrom, admitting feedstock airlessly to the top of the vessel and centrifugally dispersing the feedstock by a fan into immediate contact with the heated inside of the vessel, for decomposition into gas and ash, and exerting a cyclone motion on the product gas within the vessel for cracking it and for ridding it substantially of particulate matter such as ash, the gas being conducted to an outlet along a central axial path through the vessel.

The present invention provides at an improved gasification reaction apparatus. According to the invention, therefore, there is provided a gasification reactor apparatus, comprising a combustion chamber wherein is mounted a gasification vessel which has an inlet for feedstock to be gasified and an outlet for discharging product gas, the inlet including air-isolating and sealing means for preventing ingress of air to the vessel with feedstock, and in an upper part of the vessel there is a combination rotary fan and cyclone unit which, in use, respectively (a) disperses incoming feedstock into contact with a heated inside wall of the vessel and (b) establishes a cyclone in the product gas for ridding the gas of particulate matter before discharge from the outlet.

The invention will now be described in more detail, by way of example only, with reference to the accompanying drawings, in which.

Figure 1:
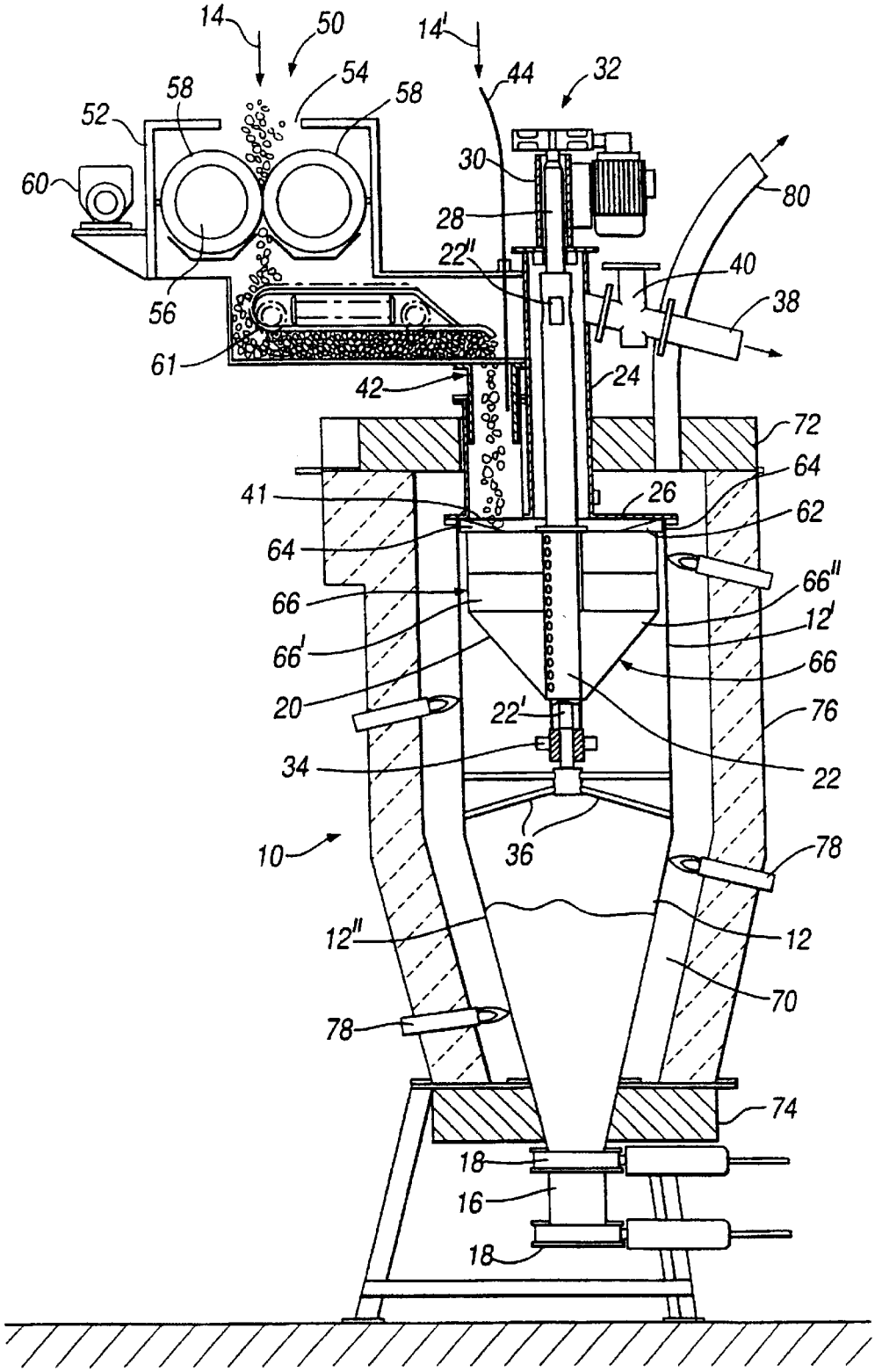
FIG. 1 is a part-sectional view of a first gasification reaction apparatus according to the present invention.

The gasification reaction apparatus 10 of FIG. 1 comprises a gasification vessel 12, e.g. made of stainless steel. In this vessel, feedstock 14, 14' is pyrolytically converted into high calorific value gas, and ash, in a non-oxidizing atmosphere inside the vessel 12. The vessel 12 has a right-cylindrical upper part 12' and a frusto-conical lower part 12" which tapers towards and terminates in an ash collector 16. The latter is provided with two spaced-apart gate valves 18 which form an air lock, by means of which ash can periodically be discharged without letting air into the gasification vessel 12.

The gasification vessel 12 has a cyclone fan unit 20 in its upper part 12', the cyclone fan 20 being mounted on a hollow shaft 22 which extends upwards from the vessel. The shaft is contained inside an upstanding duct 24 welded to a top cover 26 of the vessel. In turn, the shaft 22 is coupled to a drive shaft 28. The drive shaft 28 is suspended in a sealed, air and gas tight bearing assembly 30 which closes the top of the duct 24, and preferably is fluid cooled. Electric motor drive device 32 is provided for rotating the two shafts 22, 28 and hence the cyclone fan 20.

The two shafts 22, 28 are in essence supported only by the bearing assembly 30. Shaft 22 extends down through the cyclone fan 20. Mounted on its bottom end is a graphite bush 34, which internally receives a centering pin mounted on a spider 36. There is a clearance of 1 mm or so between the inside of bush 34 and the centering pin. Together, the bush and pin do not function as a bearing for the shaft 28; only the bearing assembly 30 supports the shaft for rotation. The pin and bush 34 primarily constitute a safety measure, to constrain or restrict radial movement of the shaft 22 and cyclone fan 20 to within safe limits.

Air cannot enter the apparatus 10 and particularly the vessel 12 as described so far, nor can gas escape from the vessel except by way of a gas duct 38. Duct 38 is branched from the upstanding duct 24, and includes a connection 40 to a safety pressure seal, not shown.

Feedstock 14, 14' for conversion into gas is introduced airlessly into vessel 12 through an inlet 41 featuring an air-tight, telescopic expansion conduit 42 which is welded to the top cover 26. In the main, the feedstock 14 will be municipal solid waste in small particulate, dried form which is largely fibrous in nature. However, the feedstock is by no means limited to municipal solid waste. Indeed, other organic feedstocks can be used and they need not be solid. For instance, used oils can be fed by line 44 into the vessel 12 for gasification as feedstock 14'. Such oils can be converted into especially high calorific value gas. In some cases, it may be desirable to introduce both solid and liquid feedstocks at the same time to the vessel 12 as using a mixture of feedstock allows the chemical composition and calorific value of the product gas to be controlled.

Solid feedstock is airlessly supplied to the vessel inlet 41 by a sealed feeder apparatus 50.

Briefly, the feeder apparatus 50 which supplies the solid feedstock airlessly to the conduit 42, comprises a chamber 52 with a feedstock inlet 54 and a feedstock outlet which opens to the conduit. Sealing means 56 at a location between the inlet and outlet spans the chamber 52. The sealing means includes a pair of contra-rotary rollers 58 contacting each other and forming a yieldable nip. The nip is of a substantial vertical extent and allows feedstock to pass between the rollers 58 in its passage toward the outlet, and forms a seal substantially preventing gas or air from passing between the rollers.

The sealed feeder apparatus 50 is placed beneath a supply conveyor (not shown), to receive particulate feedstock 14 from the conveyor. The sealing means 56 effectively partitions the chamber 52 into two parts, one including the inlet 54 being open to the atmosphere and the other, below the sealing means, being isolated thereby from the atmosphere. Thanks to the yieldable rollers 58, which are driven by a motor 60, feedstock 14 falling under gravity from the conveyor is passed, without air, into the lower part of the chamber 52. From there, the feedstock is advanced to the outlet, conduit 42 and inlet 41 by an oscillating bar conveyor 61, of known kind. The lower part of the chamber can be provided with at least one gas fitting (not shown). By this means, at start up of apparatus 10 the lower part of the chamber can be evacuated or flushed with inert gas. It will be filled with gas produced in the vessel 12 during actual gasification operation.

As stated, the sealing means comprises a pair of contacting, contra-rotating rollers 58 forming a yieldable sealing nip, the rollers having yieldable, resilient compressible peripheries formed by polymeric tyres. Particles of feedstock which enter the yieldable sealing nip are conveyed downwardly, in the nip, the resilient, compressible peripheries yielding, or giving to embrace and entrap the feedstock particles while simultaneously preventing any significant quantity of air from passing into the lower part of the chamber 52.

The cyclone fan 20 comprises an uppermost metal disc 62 rigidly affixed to the hollow shaft 22. On the top surface of the disc 62, fan blades 64 are mounted. The disc 62 and blades 64 are disposed close beneath the top cover 26 of vessel 12, so that the blades rotate close beneath the inlet 41. There can be three, four or more fan blades 64.

Also rigidly affixed to the shaft 22, and to the bottom surface of the disc, are a plurality of metal paddles 66, e.g. four in number. Each paddle 66 can project radially from the shaft, and can have its outermost part bent, curved or angled forwardly, i.e. in the direction of rotation of the cyclone fan. The paddles 66 are disposed at even spacings about the shaft 22. Instead of projecting radially of the shaft 22, the paddles can be—and preferably are—disposed tangentially to it, so as to project forwardly in the direction of rotation of the cyclone fan. Again, in this arrangement each paddle 66 has its outermost part bent, curved or angled forwardly. In use, when the cyclone fan is rotating, the paddles 66 set up a swirling motion of the gas in the vessel 12, as will be described later.

The paddles 66 each have a square or rectangular upper part 66' and a tapered, triangular lower part 66 ".

The metal disc 62, fan blades 64 and paddles 66 can be made of stainless steel, welded to one another and to the shaft 22.

The vessel 12 is mounted inside a combustion chamber 70. The combustion chamber has a top 72, bottom 74 and sidewall 76 fabricated from steel with thick insulating linings, e.g. of firebricks, fireclay or ceramic fibre. A plurality of gas burners 78 are mounted at spaced intervals about the sidewall 76 of the chamber 70. They burn a mixture of combustible gas and air, and in operation heat the vessel to a temperature of about 900° C. or more. In use, the combustible gas can be a proportion of the gas produced by gasification of the feedstock. When starting the gasification process, however, any convenient combustible gas can be substituted, e.g. propane.

The gas burners 78 are preferably as described in our British patent application GB 9812975.2 but any suitable burner may be used.

Combustion products within the chamber 70 are exhausted to atmosphere by exhaust duct 80. Preferably, the gaseous combustion products are first cooled by heat exchange in a steam or hot water generator (not shown). The recovered heat is desirably used in the plant, e.g. the drier used for removing moisture from the feedstock. After heat exchange, the combustion products are then exhausted to atmosphere.

Operation of the gasification reaction apparatus 10 will now be described.

Upon start up from cold, an inert gas such as nitrogen is introduced into the vessel 12 through an inlet (not shown), and exhausted via the duct 38. The sealed feeder apparatus 50 is also flushed with inert gas.

While the inert gas atmosphere is maintained in the vessel 12, the burners 78 are ignited and the vessel is brought up to temperature. The temperature of vessel 12 can be assessed by known means such as a pyrometer (not shown). Meanwhile, the cyclone fan 20 is rotated at a speed of 500–1000 rpm by the electric motor drive device 32.

Once vessel 12 is at the desired temperature, supply of feedstock is commenced. Feedstock 14, 14' passing through the inlet 41 encounters the rapidly-revolving fan blades 64 and is flung outwards against the hot inside surface of the vessel 12. Gasification into high calorific value gas commences rapidly, it is believed within one hundredth of a second. Such rapid onset of gasification is thought to be an important factor in the avoidance of dioxins production. As feedstock supply and gasification continue, it is found that the gas produced exerts a propelling effect on the cyclone fan 20, maintaining its rotation. As a result, electric power to the drive motor device 32 can be switched off. Moreover, it can then be used as a generator of electricity usable in the plant. As gasification proceeds, supply of inert gas can be shut off and the high calorific gas can be caused to exit the vessel 12 via duct 38 for further treatment, collection and use.

During gasification, the produced gas may be contaminated by particulates. However, as noted above, the paddles 66 set up a swirling motion—or cyclone effect—in the gas. As a result, the particulate matter is projected outwardly against the inside of vessel 12. If this matter has not been fully gasified, its decomposition and gasification will continue in the vicinity of the inside of vessel 12, and ultimately it is converted to ash. The cyclone effect successfully rids the gas of particulate contaminants.

The gas produced in due course enters the hollow shaft 22 by way of lower openings 22' therein. It passes up the shaft 22 and issues into the upper region of the duct 24 via shaft openings 22".

Most of the gas leaves duct 24 via duct 38, but a proportion of the gas passes down the duct 24 back into the vessel 12, into which it is drawn by the centrifugal action of the fan blades 64, the gas drawn in assisting the flow of incoming feedstock to the hot inside surface of the vessel 12.

Gas entering the duct 38 is passed to a blast cooler or scrubber, where it is very rapidly cooled by passage through cooling water or oil sprays. Cooling by such a cooler or scrubber leaves the gas in a particularly clean state, and can ensure that conversion of its components into contaminants such as dioxins is successfully avoided. The ensuing gas burns very cleanly and its combustion products can pose minimal environmental problems when discharged to atmosphere.

The gas produced can be used in small part to feed the burners 78. The main gas production is converted into heat or electrical energy.

By way of non-limitative example, the apparatus 10 can have a cyclone fan 20 of 3.6 m diameter, and the vessel 12 can consume about 1.5 tonne of dry municipal solid waste per hour. Such apparatus can commence gas production about 1 hour after starting up from cold. In emergency, gas production can be halted in about 25 seconds by terminating the supply of feedstock.

The efficiency of conversion of feedstock 14, 14' into gas is of the order of 90–95%.

The gas produced per hour can yield about 2.5 to 14 MW, depending on the nature of the feedstock 14, 14'. If this gas is consumed in a turbine generator to produce electricity, the peak conversion efficiency is 42% or so. In practice, depending on the quality of the feedstock, 0.7 to 4.5 MW of electricity can be generated from 1.0 tonne of the dry feedstock.

If the gas obtained from the apparatus 10 is used partly for heating (e.g. space heating) and partly for electricity generation, yields may be 30% electrical energy and 50% heat energy. Expected energy loss is 20%.

The following tabulation is an analysis of the gas generated by the gasifier of FIG. 1 and demonstrates the lack of chlorinated contaminants.

| | |
|---|---|
| Total Chlorinated Compounds (excluding Freons) | ND |
| Comprising | |
| Dichloromethane | <1 |
| 1,1,1-Trichloroethane | <1 |
| Trichloroethylene | <1 |
| Tetrachloroethylene | <1 |
| 1,1-Dichloroethane | <1 |
| cis-1,2-Dichloroethylene | <1 |
| Vinyl Chloride | <1 |
| 1,1-Dichloroethylene | <1 |
| trans-1,2-Dichloroethylene | <1 |
| Chloroform | <1 |
| 1,2-Dichloroethane | <1 |
| 1,1,2-Trichloroethane | <1 |
| Chlorobenzene | <1 |
| Chloroethane | <1 |
| Total Fluorinated Compounds | ND |
| Total Organo-Sulphur Compounds | ND |

In contrast, landfill gas is much more contaminated, as the following tabulation demonstrates. The analysis are for three different gas samples from landfill in Distington, Cumberland, England.

| Compounds | Sample 1 | Sample 2 | Sample 3 |
|---|---|---|---|
| Total Chlorinated Compounds (excluding Freons) | 2715 | 2772 | 2571 |
| Comprising | | | |
| Dichloromethane | 146 | 144 | 120 |
| 1,1,1-Trichloroethane | 31 | 31 | 26 |
| Trichloroethylene | 370 | 380 | 355 |
| Tetrachloroethylene | 1030 | 1060 | 1030 |
| 1,1-Dichloroethane | 22 | 23 | 19 |
| cis-1,2-Dichloroethylene | 668 | 671 | 603 |
| Vinyl Chloride | 310 | 320 | 290 |
| 1,1-Dichloroethylene | 11 | 12 | 10 |
| trans-1,2-Dichloroethylene | 22 | 21 | 19 |
| Chloroform | 6 | 7 | 6 |
| 1,2-Dichloroethane | 69 | 70 | 62 |
| 1,1,2-Trichloroethane | 4 | 4 | 4 |
| Chlorobenzene | 18 | 20 | 19 |
| Dichlorobenzenes | 2 | 3 | 3 |
| Chloroethane | 6 | 6 | 5 |
| Total Fluorinated Compounds | 64 | 62 | 54 |
| Total Organo-Sulphur Compounds | 46 | 46 | 41 |
| Total Chlorinated Compounds as C1 | 2130 | 2180 | 2030 |
| Total Fluorinated Compounds as F | 19 | 19 | 17 |

In the foregoing four analyses, the concentration unit is $mg/m^3$, and "ND" means not detected.

Gas produced by the present apparatus 10 has, as its major constituents, various hydrocarbons, hydrogen, carbon monoxide and carbon dioxide. The following tabulation shows the principal constituents and calorific values for two gas samples obtained by use of the present apparatus.

| Composition | Sample 1 | Sample 2 |
|---|---|---|
| Methane (%) | 23.9 | 54.2 |
| Carbon Dioxide (%) | 12.9 | 2.9 |
| Nitrogen (%) | 1.5 | 2.0 |
| Oxygen (%) | <0.1 | 0.3 |
| Hydrogen (%) | 16.7 | 17.7 |
| Ethylene (%) | 8.8 | 11.7 |
| Ethane (%) | 1.5 | 3.1 |
| Propane (%) | 1.8 | 2.6 |
| Acetylene (%) | 0.34 | 0.10 |
| Carbon Monoxide (%) | 32.6 | 5.4 |
| Calorific Value ($MJ/m^3$ at 15° C. & 101.325 kPa) | | |
| Gross | 23.1 | 34.8 |
| Net | 21.3 | 31.6 |

Sample 1 was gas produced by gasifying a municipal solid waste. Sample 2 was gas produced by gasifying a mixture of oils, 50% of which were used engine lubricants. Bearing in mind that the feedstock are composed of "free" waste material which increasingly poses disposal problems, the clean gas product of high calorific value is highly beneficial. The calorific value are calculated from the gas compositions, and they compare well with the calorific value of natural gas, which is about. $38MJ/m^3$.

Referring now to FIGS. 2 to 7, a second embodiment of the present invention is a gasification reaction apparatus 100 comprising a gasification vessel 112, eg of stainless steel. As in the first embodiment, feedstock 14, 14' is pyrolytically converted in high calorific value gas and ash in a non-oxidizing atmosphere inside the vessel 112.

The vessel 112 has a cylindrical side wall 112', an upwardly domed top wall 112" and an upwardly domed bottom wall 112'", the lower ends of the side wall 112 and bottom wall 112'" merging into an annular trough 116. The trough 116 collects the ash produced by gasification of the feedstock 14, 14' which is removed from the vessel 112 via conduit 117 by operation of a rotary valve 118.

The "carbon ash" may be dealt with in one of two ways after removal from a position below the rotary valve 118 via an auger (not shown), which is fully pressure sealed.

In one case the ash is removed into an activating chamber and after is has been activated it is then removed via another auger and two air locking valves, allowing no gas release or air infiltration.

In the other case the ash is lifted to a much higher temperature and reacted with high temperature steam which fully reacts with the carbon, producing a further stream of hydrogen and carbon dioxide. The remaining inert ash is then discharged in a manner similar to the activated carbon ash.

Upper and lower hollow ducts 119 and 121 are welded to the top and bottom vessel walls 112", 112'" coaxially with each other and the gasification vessel 112. The feedstock 14 and 14" are fed into the vessel 112 via a duct 142 set in the top wall 112" of the vessel 112, offset from but, close to, the vertical axis of the vessel 112.

Figure 3:
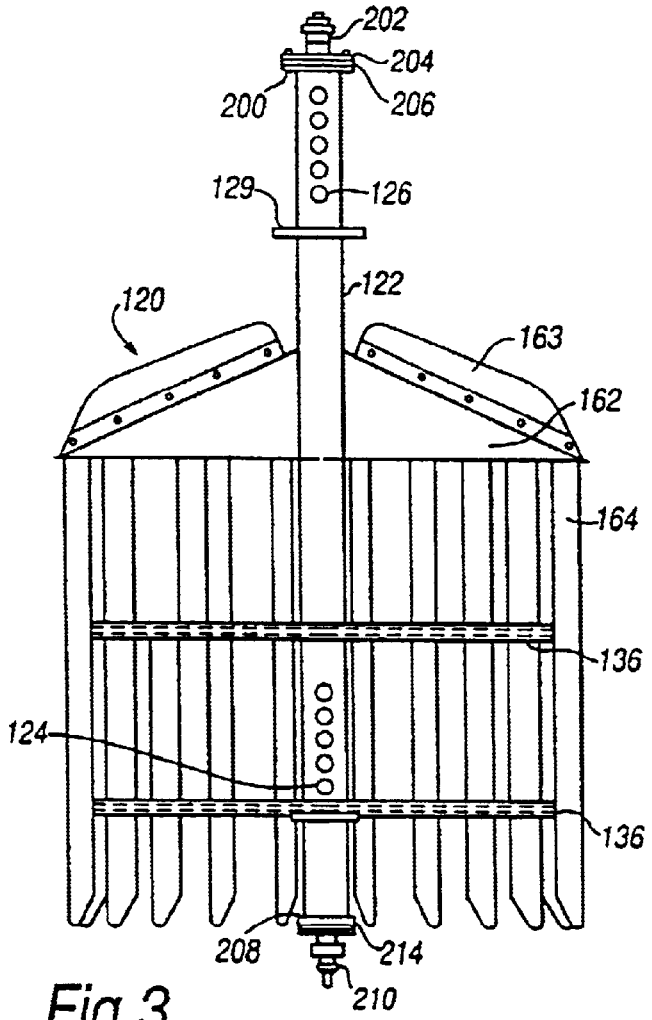
FIG. 3 is a cross-sectional view of the rotor assembly of the gasification reaction plant of FIG. 2.
Figure 4:
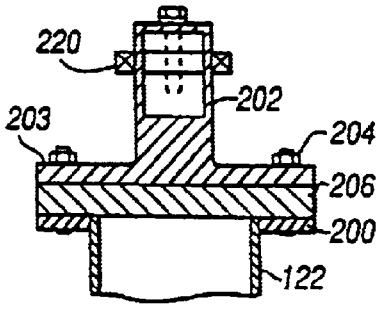
FIGS. 4 and 5 are cross-sectional views of the upper and the lower shaft assembly, respectively, which support the rotor assembly of the gasification reaction plant of FIG. 2.
Figure 7:
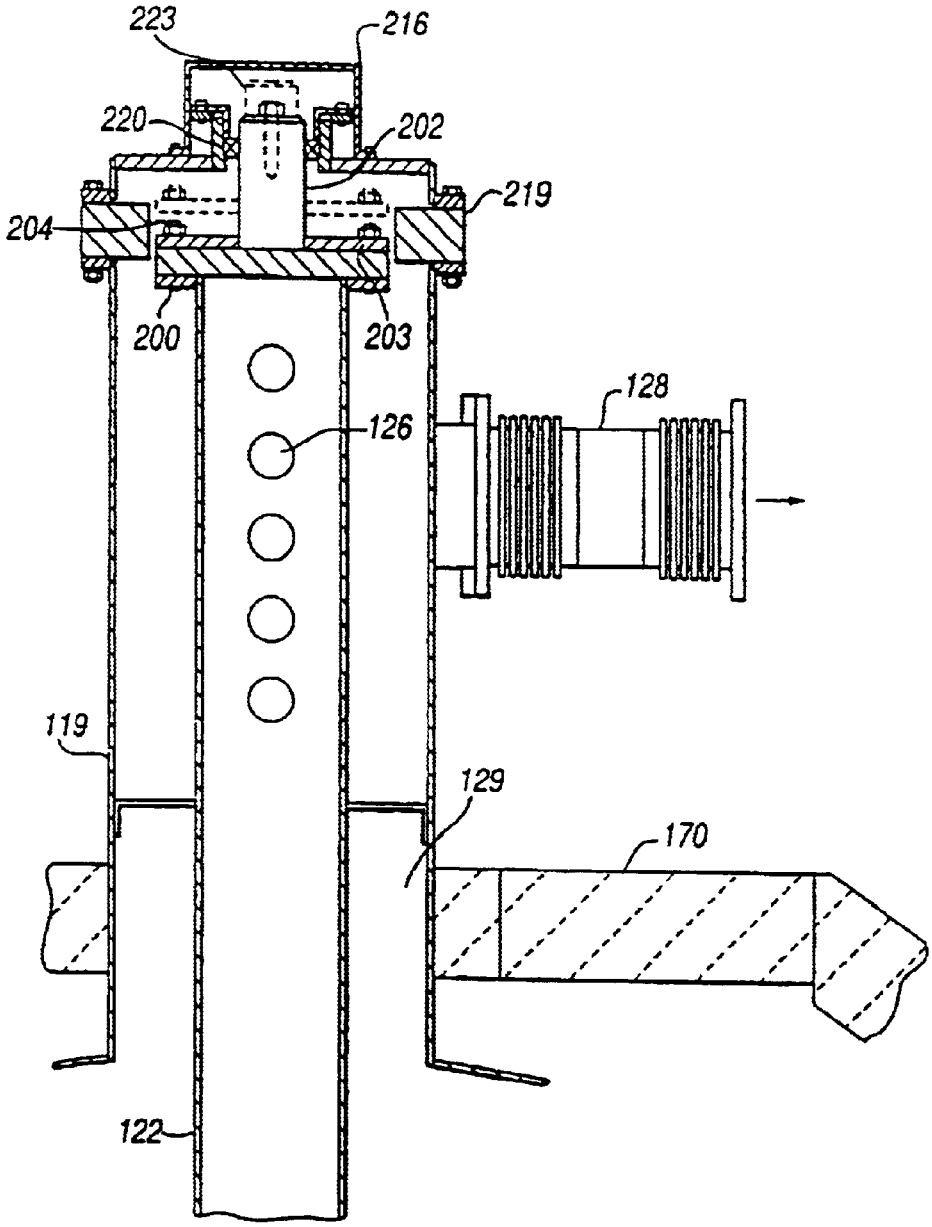
FIG. 7 is a detailed view of ringed portin VII of FIG. 2.

The gasification vessel 112 has a cyclone fan unit 120 mounted on a hollow shaft 122 supported for rotation about its axis within the ducts 119 and 121. Referring particularly to FIGS. 3, 4 and 7, the upper end of the shaft 122 has welded to it an outer, annular collar 200 to which is bolted an upper mounting shaft 202 with flange 203 by bolts 204. A disc 206 of ceramic insulator is sandwiched between the collar 200 and flange 203 of the shaft 202 to form a thermal break.

Figure 5:
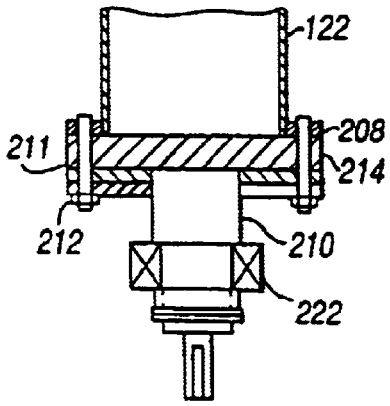
Figure 6:
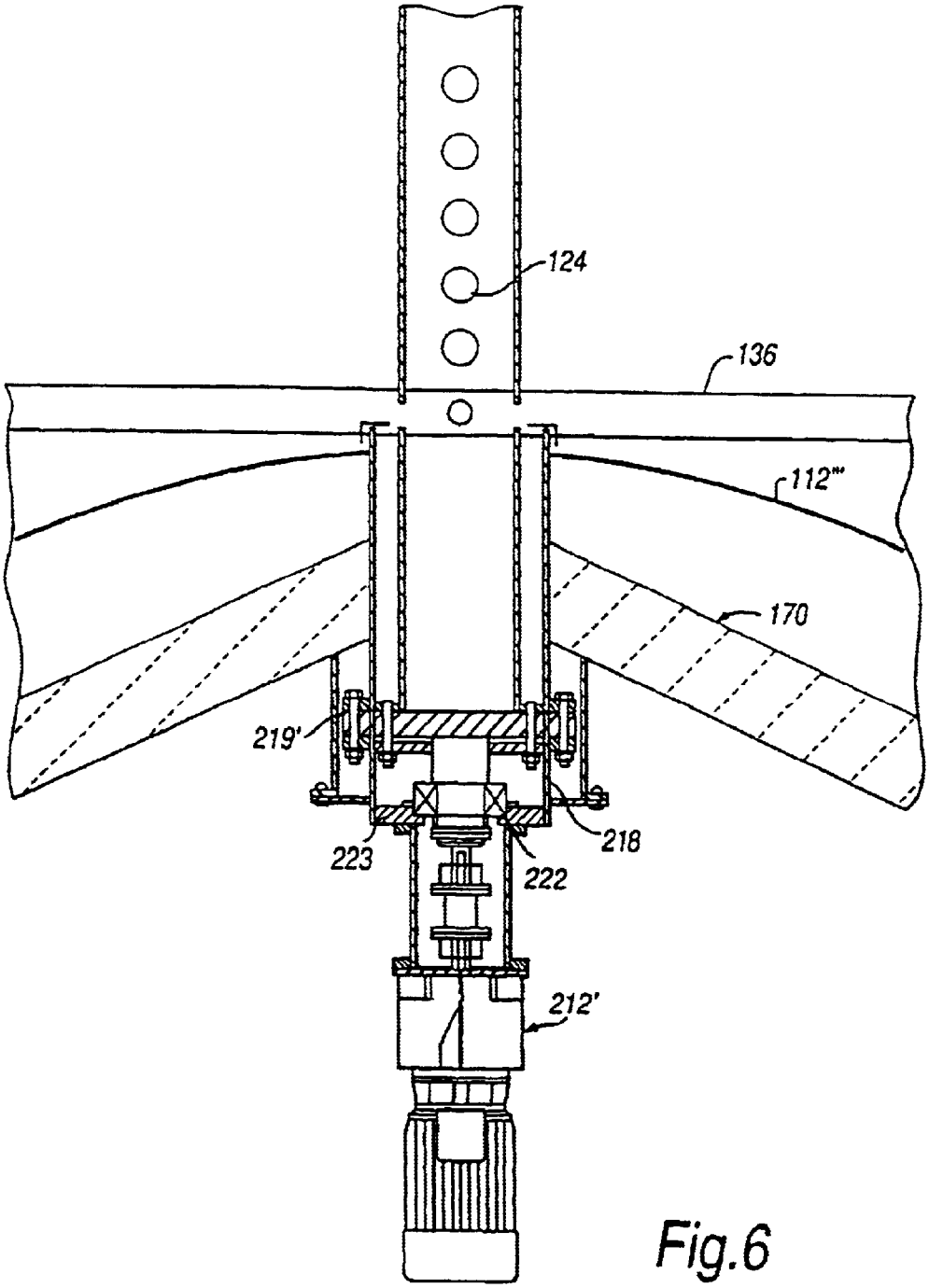
FIG. 6 is a detailed view of ringed portion VI of FIG. 2.

Referring now to FIGS. 3, 5 and 6, the lower end of the shaft 122 has welded to it an outer, annular collar 208 to which is bolted a lower mounting shaft 210 with a flange 211 by bolts 212 with a disc 214 of ceramic insulator is sandwiched between the collar 208 and flange 211 of the shaft 210, again to form a thermal break.

The upper and lower ducts 119 and 121 are capped by caps 216 and 218 with a respective ceramic insulating annulus 219, 219' between them to form thermal breaks. Mounted to the upper and lower ducts are roller bearing seal assemblies 220 and 222. The latter is located on a thrust bearing support 223 to support the cyclone fan unit 120. They also support mount shafts 202 and 210, for rotation whilst assembly 220 allows for longitudinal expansion and contraction during thermal cycling of the gasification apparatus 100 as indicated by the dotted lines 223 in FIG. 7.

The roller bearing seal assemblies support the cyclone fan 120 in a sealed air and gas tight manner. They are preferably fluid cooled.

The lower mounting shaft 210 is coupled to an electric motor drive 212', in this embodiment rated at 5.5 kW, for rotating the cyclone fan 120.

The wall of the hollow shaft 122 pierced by a row of five, vertically aligned through-holes 124, the row of holes 124 being positioned so as to be towards the lower portion of the shaft 122 whithin the vessel 112. The shaft 122 is also pierced by a row of five, vertically aligned through-holes 126, the row of holes 126 being positioned whithin the upper portion of the duct 119.

A duct 128 set in the side of the upper duct 119 is used to extract gases from the vessel 112 which pass into the interior of the shaft 122 via holes 124 and exit to within the duct 119 from the interior of the shaft 122 through holes 128. The upper portion of the duct 119 is substantially sealed from the vessel 112 by an annular gas restrictor 129.

The feedstock 14, 14' is fed airlessly into the vessel by 112 by a feeder apparatus (not shown) as described with reference to the embodiment of FIG. 1.

Figure 2:
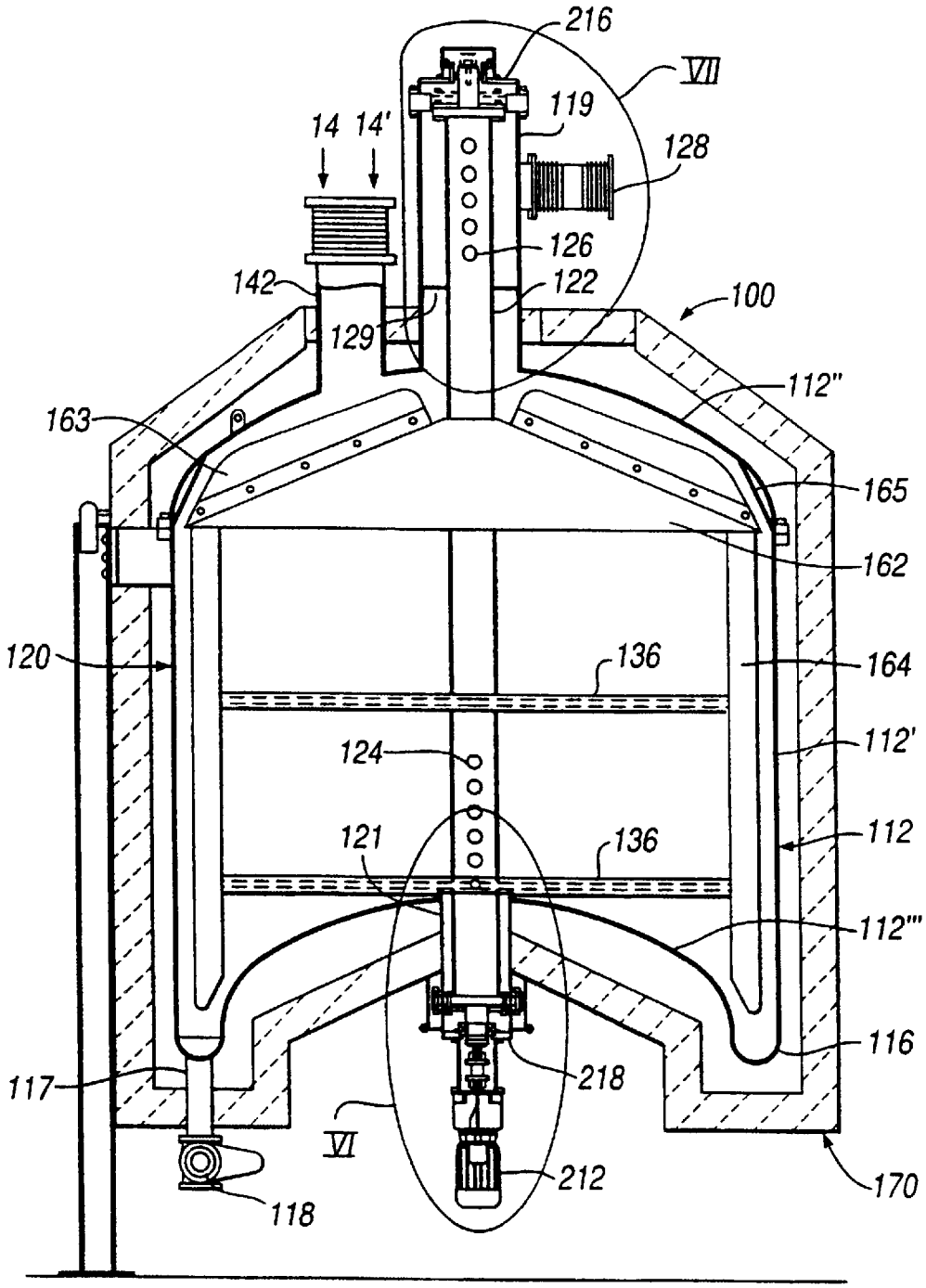
FIG. 2 is a part-sectional view of a second gasification reaction plant according to the present invention.

Referring now to FIGS. 2 and 3, the cyclone fan 120 comprises a closed conical collar 162 secured on the shaft 122 towards the top of the vessel 112 and on whose sloping upper surface are mounted four (in this case) equidistantly spaced upstanding plates 163 (two shown) extending radially from near the shaft 122 to the base of the conical collar 162.

Depending vertically downwardly from the rim of the conical collar 162 are, in this embodiment, twenty-four planar fan blades 164 which are set angled slightly away from radial alignment so as to be directed towards the direction of motion of the cyclone fan 120 viewed radially outwardly.

The fan blades 164 could also be slightly curved in the radial direction across their horizontal width.

The fan blades 164 are supported in their vertical orientation from the conical collar 162 by a pair of vertically spaced spiders 136 each fixed horizontally between the shaft 122 and each of the fan blades 164.

A frustro-conical wear tube 165 is welded to the corner of the vessel 112 at the junction of the domed top 112" and side wall 112' of the vessel 112 adjacent the outermost extent of the plates 163.

The vessel 112 is mounted inside a combustion chamber 70 with gas burners (not shown) constructed of the same materials as the combustion chamber 70 of the embodiment of FIG. 1 but configured to surround the vessel 112.

Combustion products within the chamber 70 are exhausted to atmosphere by exhaust duct (not shown).

Preferably, the gaseous combustion products are first cooled by heat exchange in a steam or hot water generator (not shown). The recovered heat is desirably used in the plant, e.g. the drier used for removing moisture from the feedstock. After heat exchange, the combustion products are then exhausted to atmosphere.

Operation of the gasification reaction apparatus 100 is as described above with reference to the apparatus of FIG. 1.

Upon start up from cold, an inert gas such as nitrogen is introduced into the vessel 112 through an inlet (not shown).

While the inert gas atmosphere is maintained in the vessel 112, the vessel 112 is brought up to temperature, and the cyclone fan 120 rotated at a speed of 500–1000 rpm by the electric motor drive device 212.

Once vessel 112 is at the desired temperature, supply of feedstock is commenced. Feedstock 14, 14' passing through the inlet duct 142 encounters the rapidly-revolving plates 163 and is flung outwards against the hot inside surface of the vessel 112, the wear plate 165 shielding the vessel 112 at the inital impact point with the vessel 112. Gasification into high calorific value gas commences rapidly, as before. As feedstock supply and gasification continue, the gas produced exerts a propelling effect on the cyclone fan 120, maintaining its rotation and, again, electric power to the drive motor device 212 can be switched off and it can then be used as a generator of electricity usable in the plant. As gasification proceeds, supply of inert gas can be shut off and the high calorific gas can be caused to exit the vessel 112 via duct 128 for further treatment, collection and use.

The paddles 164 set up and maintain a swirling motion-or cyclone effect-in the gas in the volume of the vessel 112 with the particulate matter being projected outwardly against the inside of vessel 112. If this matter has not been fully gasified, its decomposition and gasification will continue in the vicinity of the inside of vessel 112, and ultimately it is converted to ash. The cyclone effect successfully rids the gas of particulate contaminants as the gas produced in due course enters the hollow shaft 122 at the centre of the vessel, away from the particulates which are flung to the vessel side wall 112' by way of lower openings 124 therein. It passes up the shaft 22 and issues into the upper region of the duct 119 via shaft openings 126.

Most of the gas leaves duct 119 via duct 128, but a proportion of the gas passes down the duct 119 back into the vessel 112, into which it is drawn by the centrifugal action of the plates 163, the gas drawn in assisting the flow of incoming feedstock to the hot inside surface of the vessel 112.

Gas entering the duct 128 is, as before, passed to a blast cooler or scrubber, where it is very rapidly cooled by passage through cooling water or oil sprays. Cooling by such a cooler or scrubber leaves the gas in a particularly clean state, and can ensure that conversion of its components into contaminants such as dioxins is successfully avoided. The ensuing gas burns very cleanly and its combustion products can pose minimal environmental problems when discharged to atmosphere.

The gas produced can be used in small part to feed the burners (not shown). The main gas production is converted into heat or electrical energy.

It is expected that in a typical municipal disposal site, there may be as many as nine apparatuses 10 or 110 running in parallel. Power output is predicted to be of the order of 30 MW electrical energy and 50–60 MW heat energy.

The gas produced from municipal solid waste is desirably low in noxious halogenated compounds. A typical chromatographic analysis shows that the amount of such compounds is insignificant.

What is claimed is:

1. Gasification reactor apparatus, comprising a combustion chamber wherein is mounted a gasification vessel which has an upper part, an inlet for feedstock to be gasified and an outlet for discharging product gas, the inlet including air-isolating and sealing means for preventing ingress of air to the vessel with feedstock, and in said upper part of the vessel there is a combination rotary fan and cyclone unit which, in use, respectively (a) disperses incoming feedstock into contact with a heated inside wall of the vessel and (b) establishes a cyclone in said product gas for ridding said product gas of particulate matter before discharge from the outlet.

2. Apparatus according to claim 1, wherein the combustion chamber is a gas-fired furnace.

3. Apparatus according to claim 1, wherein said inlet is provided in a top cover of the vessel and the fan and cyclone unit is disposed beneath and proximate the top cover.

4. Apparatus according to claim 3, wherein the fan and cyclone unit (20) comprises a disk element (62) spaced from the top cover (26) and having fan blades (64) on an upper surface thereof for dispersing incoming feedstock (14, 14') against the heated inside wall at the top of the vessel, and the disk element being rigidly affixed to a central, axial shaft (22).

5. Apparatus according to claim 4, wherein the fan and cyclone unit (20) further includes a plurality of cyclone paddles (66) rigidly affixed to an underside of the disk element (62) and to said shaft.

6. A gasification reactor apparatus as claimed in claim 1, wherein said vessel has a side wall, and the fan and cyclone unit comprises a conical collar fixed to a rotatable shaft, said conical collar having an upper surface, there being a plurality of upstanding generally radially extending plates upstanding from said upper surface of the conical collar and a plurality of paddles depending from the conical collar so as to be adjacent said side wall of the vessel.

7. Apparatus according to claim 5 or 6, wherein each paddle has a radially outermost part which, is bent, curved or angled forwardly in the direction of rotation of the fan and cyclone unit.

8. Apparatus according to claim 2, wherein each paddle (66) is disposed tangentially to the shaft to project forwardly in the direction of rotation of the unit (20).

9. Apparatus according to claim 5 or 6, wherein each paddle (66) is disposed tangentially to the shaft to project forwardly in the direction of rotation of the unit (20).

10. A gasification reactor apparatus as claim in claim 6, including one or more spiders connecting the paddles to the shaft.

11. A gasification reactor apparatus as claimed in claim 6 or 10, wherein said plates have outer extents, and wherein said gasification reactor apparatus includes an annular wear plate attached to the vessel facing said outer extents of the plates.

12. Apparatus according to claim, 6, wherein the combustion chamber is a gas-fired furnace.

13. Apparatus according to claim 6 or 12, wherein said inlet is provided in a top cover of the vessel and the fan and cyclone unit is disposed beneath and proximate the top cover.

14. A gasification reaction apparatus as claimed in any one of claims 1 or 6, in which the vessel has a side wall, an inwardly domed bottom wall which merges with said side wall of the vessel to form an annular trough.

15. Apparatus according to claim 1 or 6, wherein the vessel has a central upstanding duct closed at a top end by a gas-tight bearing, and the fan and cyclone unit is mounted on a shaft wherein said shaft extends upwardly along the duct.

16. Apparatus according to claim 15, wherein the shaft (22) has a bush (34) at a lower end thereof, which is a loose fit around a centering pin mounted axially in the vessel (12).

17. Apparatus according to claim 16, wherein the shaft (32) is hollow and has apertures (22', 22") adjacent its lower and upper ends, the hollow shaft (32) being a conduit for conveying particulate-freed product gas to the outlet (24, 38).

18. Apparatus according to claim 15, wherein the shaft is hollow and has apertures adjacent its lower and upper ends, the hollow shaft being a conduit for conveying particulate-freed product gas to the outlet.

19. Apparatus according to claim 1 or 6, wherein the outlet is constructed and arranged to recirculate some of the product gas to the vessel in the course of its progress to discharge.

20. Apparatus according to claim 1 or 6, wherein the vessel has an air-lock duct at a bottom thereof to permit discharge of ash without admitting air to the vessel.

21. Apparatus according to claim 1 or 6, wherein the air-isolating and sealing means is a sealed feeder device for supplying feedstock airlessly to the inlet.

22. Apparatus according to claim 21, wherein said feeder device comprises a chamber having an inlet, sealing means comprising rollers with yieldable peripheries defining a yieldable sealing nip, which in use passes solid feedstock particles but not air, and a conveyor for advancing the feedstock particles to the inlet of said vessel.

23. Apparatus according to claim 22, wherein the feeder device (50) further includes a line (44) for feeding liquid feedstock (14') to the inlet (41).

24. Apparatus according to claim 21, wherein the feeder device further includes a line feeding liquid feedstock to the inlet.

25. Apparatus according to claim 1 or 6, wherein the outlet is coupled to an oil or water curtain scrubber/cooler.

* * * * *